US008020975B2

(12) United States Patent
Lean et al.

(10) Patent No.: US 8,020,975 B2
(45) **Date of Patent: *Sep. 20, 2011**

(54) CONTINUOUS PARTICLE TRANSPORT AND RESERVOIR SYSTEM

(75) Inventors: Meng H. Lean, Santa Clara, CA (US); John J. Ricciardelli, Poughkeepsie, NY (US); Michael J. Savino, Tappan, NY (US); Osman T. Polatkan, North Haledon, NJ (US); Fred R. Stolfi, Shrub Oak, NY (US); Eric Lindale, Kennett Square, PA (US)

(73) Assignee: Xerox Corporation, Norwalk, CT (US)

( * ) Notice: Subject to any disclaimer, the term of this patent is extended or adjusted under 35 U.S.C. 154(b) by 1094 days.

This patent is subject to a terminal disclaimer.

(21) Appl. No.: 11/167,951

(22) Filed: Jun. 28, 2005

(65) Prior Publication Data

US 2006/0119667 A1 Jun. 8, 2006

Related U.S. Application Data

(60) Provisional application No. 60/633,042, filed on Dec. 3, 2004.

(51) Int. Cl.

| | |
|---|---|
| ***B41J 2/02*** | (2006.01) |
| ***B41J 2/215*** | (2006.01) |
| ***B41J 2/18*** | (2006.01) |
| ***B41J 2/17*** | (2006.01) |
| ***B41J 2/415*** | (2006.01) |

(52) U.S. Cl. ..... 347/73; 347/83; 347/89; 347/97; 347/120

(58) Field of Classification Search ..... 347/120, 347/73, 83, 89, 97

See application file for complete search history.

(56) References Cited

U.S. PATENT DOCUMENTS

| | | | | | |
|---|---|---|---|---|---|
| 3,779,166 | A | * | 12/1973 | Pressman et al. | 347/124 |
| 4,527,884 | A | | 7/1985 | Nusser | |
| 4,558,941 | A | | 12/1985 | Nosaki et al. | |
| 4,647,179 | A | | 3/1987 | Schmidlin | |
| 4,780,733 | A | * | 10/1988 | Schmidlin | 347/55 |
| 4,896,174 | A | | 1/1990 | Stearns | |
| 5,204,696 | A | * | 4/1993 | Schmidlin et al. | 347/55 |
| 5,281,982 | A | | 1/1994 | Mosehauer et al. | |
| 5,374,981 | A | * | 12/1994 | Yamamoto et al. | 347/149 |
| 5,400,062 | A | | 3/1995 | Salmon | |
| 5,717,986 | A | | 2/1998 | Vo et al. | |
| 5,850,587 | A | * | 12/1998 | Schmidlin | 399/258 |
| 5,893,015 | A | | 4/1999 | Mojarradi et al. | |
| 6,025,594 | A | * | 2/2000 | Bryce et al. | 250/324 |
| 6,070,036 | A | | 5/2000 | Thompson et al. | |
| 6,112,044 | A | | 8/2000 | Thompson et al. | |
| 6,116,718 | A | | 9/2000 | Peeters et al. | |
| 6,134,412 | A | | 10/2000 | Thompson | |
| 6,137,979 | A | | 10/2000 | Gartstein et al. | |
| 6,219,515 | B1 | | 4/2001 | Lestrange | |
| 6,246,855 | B1 | | 6/2001 | Gartstein et al. | |
| 6,272,296 | B1 | | 8/2001 | Gartstein | |
| 6,290,342 | B1 | | 9/2001 | Vo et al. | |
| 6,293,659 | B1 | | 9/2001 | Floyd et al. | |
| 6,328,409 | B1 | | 12/2001 | Peeters et al. | |
| 6,340,216 | B1 | | 1/2002 | Peeters et al. | |

(Continued)

*Primary Examiner* — Stephen Meier
*Assistant Examiner* — Sarah Al Hashimi
(74) *Attorney, Agent, or Firm* — Fay Sharpe LLP

(57) ABSTRACT

Various configurations and applications of traveling wave grids are disclosed. Systems for transporting particles to feed apertures, and/or for transporting particles from storage reservoirs are described. The systems are particularly useful for transporting toner particles in printing systems.

25 Claims, 8 Drawing Sheets

U.S. PATENT DOCUMENTS 6,351,623 B1 2/2002 Thayer et al.
6,416,158 B1 7/2002 Floyd et al.
6,416,159 B1 7/2002 Floyd et al.
6,439,711 B1 8/2002 Carlini et al.
6,454,384 B1 9/2002 Peeters et al.
6,467,862 B1 10/2002 Peeters et al.
6,467,871 B1 10/2002 Moffat et al.
6,499,831 B2 12/2002 Schmidlin
6,511,149 B1 * 1/2003 Peeters et al. ..... 347/21
6,521,297 B2 2/2003 McDougall et al.
6,523,928 B2 2/2003 Peeters et al.
6,598,954 B1 7/2003 Moffat et al.
6,719,399 B2 4/2004 Moffat et al.
6,751,865 B1 6/2004 Peeters et al.
7,293,862 B2 * 11/2007 Lean et al. ..... 347/85
2004/0251135 A1 * 12/2004 Lean et al. ..... 204/456
2006/0092234 A1 * 5/2006 Lean et al. ..... 347/65

* cited by examiner

CONTINUOUS PARTICLE TRANSPORT AND RESERVOIR SYSTEM

CROSS REFERENCE TO RELATED PATENTS AND APPLICATIONS

The present exemplary embodiment claims priority of U.S. Provisional Application Ser. No. 60/633,042 filed Dec. 3, 2004.

BACKGROUND

The present exemplary embodiment relates to the transport of small particles. It finds particular application in conjunction with the printing and scientific instrumentation arts, and will be described with particular reference thereto. However, it is to be appreciated that the present exemplary embodiment is also amenable to other like applications such as pharmaceutical processing of medication.

BRIEF DESCRIPTION

In accordance with one aspect of the present exemplary embodiment, a system is provided for transporting particles from a first location such as a reservoir or storage location, to a feed aperture in communication with a flowing feed stream. The system comprises a member adapted to direct a feed stream flowing along a region of the member. The member defines an aperture which provides communication with the feed stream. The system also comprises at least one traveling wave grid extending from the first location to a location proximate the aperture. Upon operation of the traveling wave grid and deposition of particles on or in proximity to the traveling wave grid, at least a portion of the particles are transported from the first location to the feed aperture.

The traveling wave grid assembly includes a non-planar traveling wave grid segment that serves to recirculate and provide a continuous, or nearly so, supply of particles to the location proximate the aperture.

In accordance with another aspect of the present exemplary embodiment, a system for transporting particles from a reservoir to a destination location is provided. The system comprises a reservoir defining a hollow interior and a discharge. The reservoir is adapted to retain and dispense particles from the discharge. The system also comprises at least one traveling wave grid extending between a location proximate the discharge of the reservoir and the destination location. Upon operation of the traveling wave grid and discharge of particles from the reservoir onto the traveling wave grid, at least a portion of the particles are transported from the discharge to the destination location.

In accordance with another aspect of the present exemplary embodiment, a system is provided for transporting particles from a reservoir to an aperture in communication with a flowing feed stream. The system comprises a member adapted to direct a feed stream flowing along a region of the member. The member defines an aperture extending through the member and providing communication with the feed stream. The system also comprises a reservoir defining a hollow interior and a discharge. The reservoir is adapted to retain and dispense particles from the discharge. The system also comprises at least one traveling wave grid extending between a first location proximate the aperture defined in the member, and a second location proximate the discharge of the reservoir. Upon operation of the wave grid, and discharge of particles on or in proximity to the wave grid, at least a portion of the particles are transported from the first location to the second location.

DETAILED DESCRIPTION

The exemplary embodiment provides systems and techniques for the storage, transport, and controlled distribution of small particles such as for example, toner particles. Although the exemplary embodiment is described in terms of the printing arts and transporting toner particles, it is to be understood that the exemplary embodiment includes other applications involving the storage, transport, or distribution of minute particles. Specifically, the exemplary embodiment provides systems and methods for establishing a continuous supply of low agglomeration toner for pixel writing in ballistic aerosol marking (BAM) applications. The exemplary embodiment system and method simultaneously fluidizes, transports, and supplies toner to gating apertures for on-demand printing in BAM systems. The exemplary embodiment system optionally uses an electrostatic traveling wave grid implemented on a modified scavengeless electroded donor (SED) roll.

Figure 1:
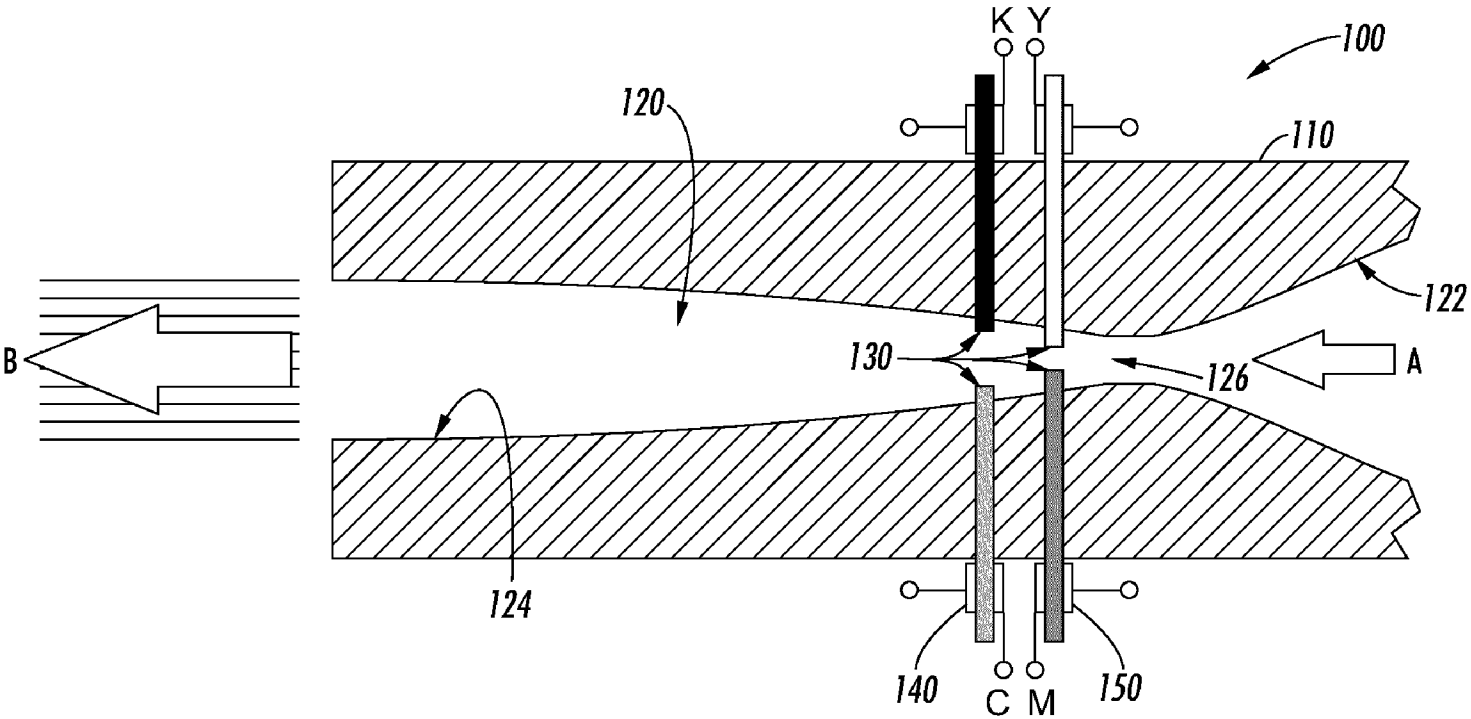
FIG. 1 is a schematic of a ballistic aerosol marking system using an exemplary embodiment particle feed system.

BAM is a technology being developed for high speed printing either directly onto paper or indirectly via an intermediate medium. BAM uses high-speed continuous gas jets to move small toner particles to the print medium. More recently, the range of marking materials has been extended to include liquid inks comprised of particulates in suspension in a carrier fluid such as Isopar®. The print head is comprised of an array of individually controlled micro-channels, each of which is a Laval nozzle incorporating a Venturi structure (converging/diverging channel) to accelerate and focus the narrow gas jets. BAM is designed to be a true color CMYK printing system, whereby metered amounts of component colors for individual nozzles are injected on-demand into a jet stream at the same time to be conveyed to the print medium. A schematic of such a system is shown in FIG. 1, and is described in greater detail. This technology can utilize and dispense high viscosity inks to minimize inter-color bleed. Since the system is designed as a single-pass print engine, there is no additional requirement for color registration. Images are formed when the individually controlled micro-channels combine to lay down the component image patterns. Although in theory toners may be designed for kinetic fusing on impact, a practical compromise is to lower gas pressure and optimize toner morphology together with print medium surface treatment to minimize backscatter or bounce-back of the toner on impact. Details and information relating to ballistic aerosol marking systems, components, and processes are described in the following U.S. Pat. Nos. 6,751,865; 6,719,399; 6,598,954; 6,523,928; 6,521,297; 6,511,149; 6,467,871; 6,467,862; 6,454,384; 6,439,711; 6,416,159; 6,416,158; 6,340,216; 6,328,409; 6,293,659; and 6,116,718; all of which are hereby incorporated by reference.

Specifically, FIG. 1 illustrates a system 100 for use in a BAM direct marking operation. The system 100 comprises a body 110 defining a channel 120 with an entrance 122, an exit 124, and a narrowed constriction 126 defined therebetween. The channel 120 has a configuration known to those skilled in the art as a Laval expansion pipe. High pressure gas such as carbon dioxide at a pressure of up to about 72 atmospheres, is administered to the entrance 122 of the channel 120. This flow is shown in FIG. 1 as arrow A. The system 100 also comprises one or more particle feed systems such as those shown in FIG. 1 as C, M, Y, and K. Each feed system can include a particle feed apparatus and corresponding electrostatic gate designated for example as 140 and 150, respectively. The highly pressurized gas passes through the constriction 126 and entrains or otherwise draws particles or toner from the various feed systems at a feed 130. As the gas and entrained particles flow toward the exit 124 of the channel 120, the pressure is reduced. As the gas exits the channel 120, its pressure is approximately 1 atmosphere. The flow B shown in FIG. 1 illustrates transport of the particles or toner by the gas to a substrate or print medium. Flow B is in the form of a focused, high velocity aerosol jet. Flow B may be a continuous flow, or may be pulsed or otherwise modified.

The term traveling wave grid as used herein, collectively refers to a substrate, a plurality of electrodes to which a voltage waveform is applied to generate the traveling wave (s), and one or more busses, vias, and electrical contact pads to distribute the electrical signals (or voltage potentials) throughout the grid. The term also collectively refers to one or more sources of electrical power, which provides the multi-phase electrical signal for operating the grid. The traveling wave grids may be in nearly any form, such as for example a flat planar form, or a non-planar form. The non-planarform can be, for example, in the form of an arcuate region extending along the outerwall of a cylinder. The non-planar grid could be in the form of an annular grid defined within an interior region of a tube. Yet another example of a non-planar form is that the traveling wave grid be in the form of a flexible mat or "carpet." This latter form could be extended to be planar. Traveling wave grids, their use, and manufacture are generally described in U.S. Pat. Nos. 6,351,623; 6,290,342; 6,272,296; 6,246,855; 6,219,515; 6,137,979; 6,134,412; 5,893,015; and 4,896,174, all of which are hereby incorporated by reference.

Continuous printing has been successfully demonstrated using a BAM system like that shown in FIG. 1. For pixel printing, there is critical need for a gating mechanism for on-demand metering of the toner through a small aperture into the jet stream. At 300 spi, the aperture diameter is approximately 50 μm to conform to the 84 μm channel width. For this length scale, only very low agglomeration or "powdery" 6 μm toner can be squeezed through the aperture. Modeling has shown that this is indeed possible. More recently, this capability has been experimentally demonstrated using a traveling wave grid for traveling wave transport of the toner with 90 degree coupling to the aperture as shown in FIG. 2.

Figure 2:
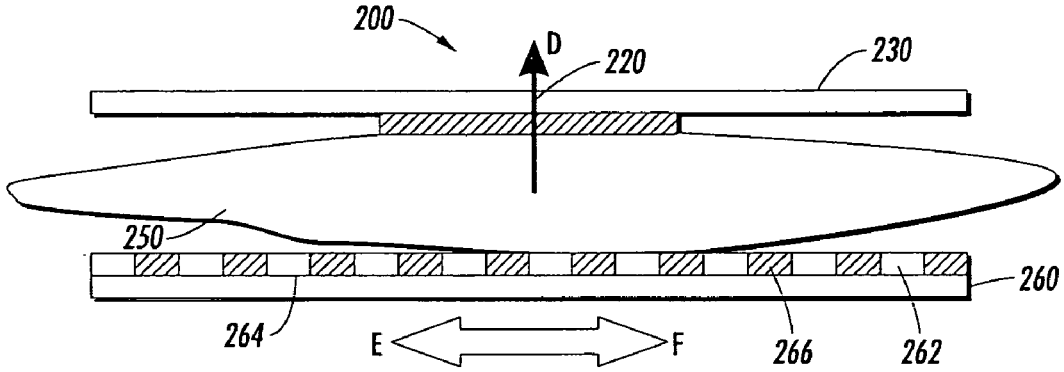
FIG. 2 is a schematic of an exemplary embodiment particle feed system.

More specifically, FIG. 2 illustrates a system 200 utilizing one or more traveling wave grids for transporting toner to a gating aperture. Specifically, system 200 comprises a gating aperture 220 defined in a member 230. The system 200 further comprises one or more traveling wave grids 260 that generally include an array of electrodes 266 disposed on a substrate 264. An optional Tedlar film 262 can be disposed on the outermost exposed face of the electrodes and substrate 266, 264. A particle, i.e. toner, cloud 250 is transported by the traveling wave grids 260 to a location proximate the gating aperture 220 of the member 230. The traveling wave grids 260 can transport toner in any direction, such as for example, in the directions of arrows E and F in FIG. 2. A selected portion or amount of particles from the cloud 250 are admitted into and through the aperture 220, and specifically, in the direction of arrow D. The aperture 220 can be fabricated from an Au coated 2 mil Kapton film with a laser-drilled 50 μm hole. A 4-phase circuit is used to drive the traveling wave grid 260. The fluidized toner or toner cloud 250 is gated through the 2-phase aperture 220 by electrostatic forces. The toner can be transported on the grid. The traveling wave grid is, for example, 8 mil pitch at 50% duty cycle. The exemplary embodiment system can utilize a wide array of traveling wave grids with numerous configurations.

The exemplary embodiment particle feed system can utilize apertures, such as aperture 220 in FIG. 2, having a wide array of shapes and span openings. Although a circular shape is typically used, other shapes such as oval, square, polygonal, and others can be utilized. For circular openings, the span or diameter can be from about 25 μm to about 75 μm, with 50 μm being typical. The exemplary embodiment includes span openings that are significantly larger, such as for example, greater than 75 μm, greater than 150 μm, greater than 250, greater than 500 μm.

Figure 3:
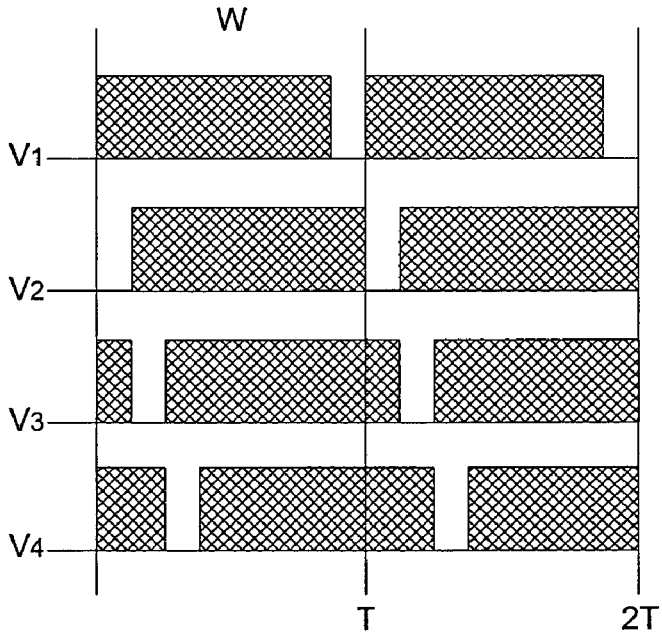
FIG. 3 is a graph illustrating voltage waveforms for a 4 phase electrical signal used in an exemplary embodiment particle feed system.

FIG. 3 shows two cycles in the voltage patterns for the traveling wave applied or induced on the grid 260 in FIG. 2. Generally, representative operating conditions for the grid 260 having a density of 0.811 gm/cm$^3$ and an electrode spacing (r) of 2.9 μm, are as follows: (i) the percentage duty cycle (W/T) is about 50%; (ii) a 90 degree phase separation is used; (iii) a frequency of 10 Hz is used; (iv) the electrode voltage ($V_{electrode}$) is about 400V; and (v) the electric field (q) is −3.07 fc. Although a 50 μm aperture does not clog, the effective aperture size is essentially reduced to 25-30 μm from 50 μm due to surface adhesion. This observation can be explained by considering that at most 8 toner particles can fit diagonally across the circular aperture. Two layers of toner particles are typically attached or otherwise adhered to the aperture walls. The first layer attaches to the aperture wall by van der Waals adhesion. The second layer attaches to the first through toner-toner cohesion.

Two modes of traveling wave propagation were studied. In a unidirectional mode, the traveling wave moves with uniform velocity across the aperture. The toner supply time window is given by w/v where w is the width of the toner patch on the traveling wave grid, and v is the velocity of motion. This mode is time-limited to several seconds in duration. A second mode allows for bi-directional travel of the toner where the traveling wave is reversed every three seconds. This mode is supply-limited as the available toner decreases over time. For high-speed printing, there is a clear need for a method capable of providing a continuous toner supply.

In the exemplary embodiment, a novel configuration is provided to simultaneously fluidize, transport, and continuously supply low-agglomeration toner to gating apertures for on-demand printing. Successful gating depends on several key factors. Principal among them is that the toner can only be lightly agglomerated. A second factor is that the toner supply must be able to continually replenish the gated toner. Finally, for any required gating rate, the toner density at the aperture inlet must be controllable. The exemplary embodiment systems described herein require consideration for fluidizing, transporting, and gating of the toner on-demand.

Figure 4:
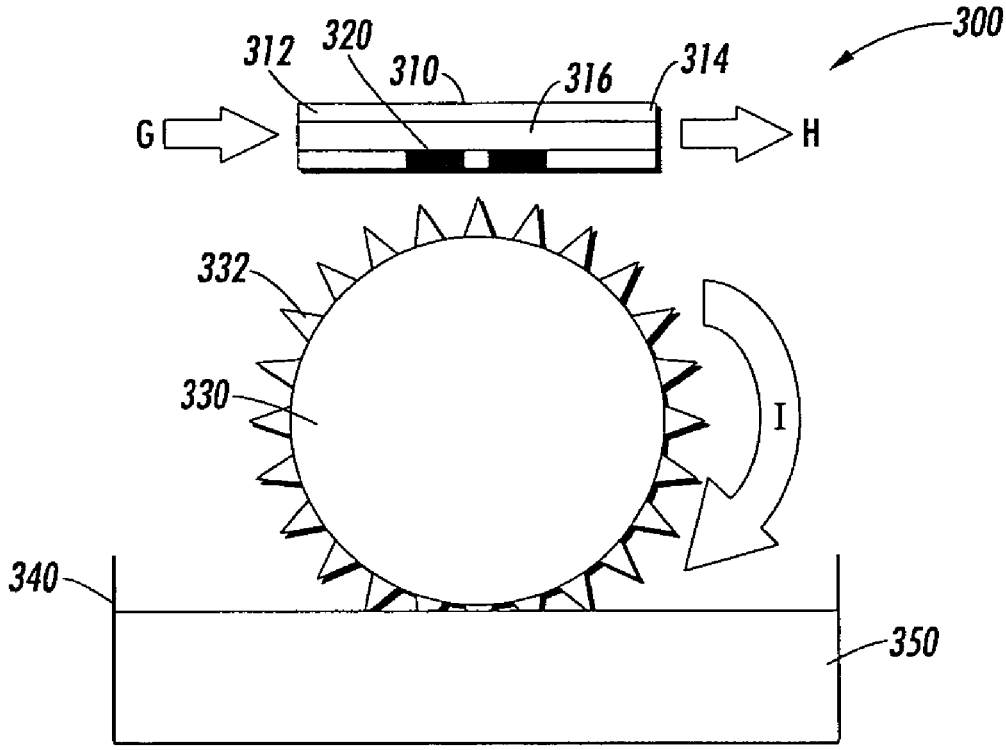
FIG. 4 is a schematic of an exemplary embodiment particle feed system.

FIG. 4 is a schematic view of an exemplary embodiment particle feed system 300. An SED (Scavengeless Electroded Donor) roll with inter-digitated electrodes on the surface, aligned in the direction of the roll axis, is modified for use in place of a planar traveling wave grid such as the traveling wave grid 260 in FIG. 2, for traveling wave transport. The roll is stationary. Specifically, FIG. 4 illustrates the system 300 comprising a gas channel 310 defining an interior channel 316 extending between an entrance 312 and an exit 314. A gas flow G enters the channel 310 and exits, as shown by arrow H, from exit 314. The channel 310 also includes a gating aperture 320 for the selective administration of particles or toner. As will be appreciated, particles admitted through the aperture 320 are generally entrained or otherwise carried by the passing gas flow. The system 300 also comprises the noted SED roll 330. The roll 330 includes one or more traveling wave grids disposed along its exterior, and specifically, a plurality of electrodes 332 along its outer periphery. The roll 330 is disposed in proximity to a supply of particles or toner 350 to be transported to the aperture 320. The supply of toner 350 can be contained in a toner sump 340, reservoir, or storage container. Upon operation of the traveling wave grid on the roll 330, toner is transported from the sump 340 past the aperture 320, such as in the direction of arrow 1. The circuit is driven such that the traveling wave moves repeatedly around the surface of the roll 330 thus providing a closed-loop continuous supply of toner to the aperture 320. The lower part of the roll 330 is disposed near the toner or collection of particles in the sump 340 and ideally, contacts toner 350 in the sump 340 for supply and replenishment. The aperture 320 is located an optimal distance above the roll surface to receive the low agglomeration toner.

Traveling wave transport of toner or other particles utilizes two major mechanisms. Referring further to FIG. 4, a "hopping" mode occurs close to the surface of the roll such as along electrodes 332 of the roll 330, and has the same phase velocity as the impressed circuit. A slower "surfing" mode rides along the surface of the toner cloud and further radially outward from the surface of the roll 330. It is this region that supplies the low agglomeration toner to the aperture 320 necessary for successfully gating.

Experiments with a planar traveling wave grid such as grid 260 in FIG. 2 have shown that this mechanism is able to gate toner on-demand repeatably through 50 μm apertures. The exemplary embodiment system is particularly adapted for providing a continuous toner supply. Modifications on the SED roll are encompassed by the exemplary embodiment to provide electrical contact to support the traveling wave signal along the electrodes on the outer periphery of the roll. In addition, the electrostatic fields in the vicinity of the aperture have been modeled to quantify the "reach" of the fringe fields and therefore the optimal gap.

Figure 5:
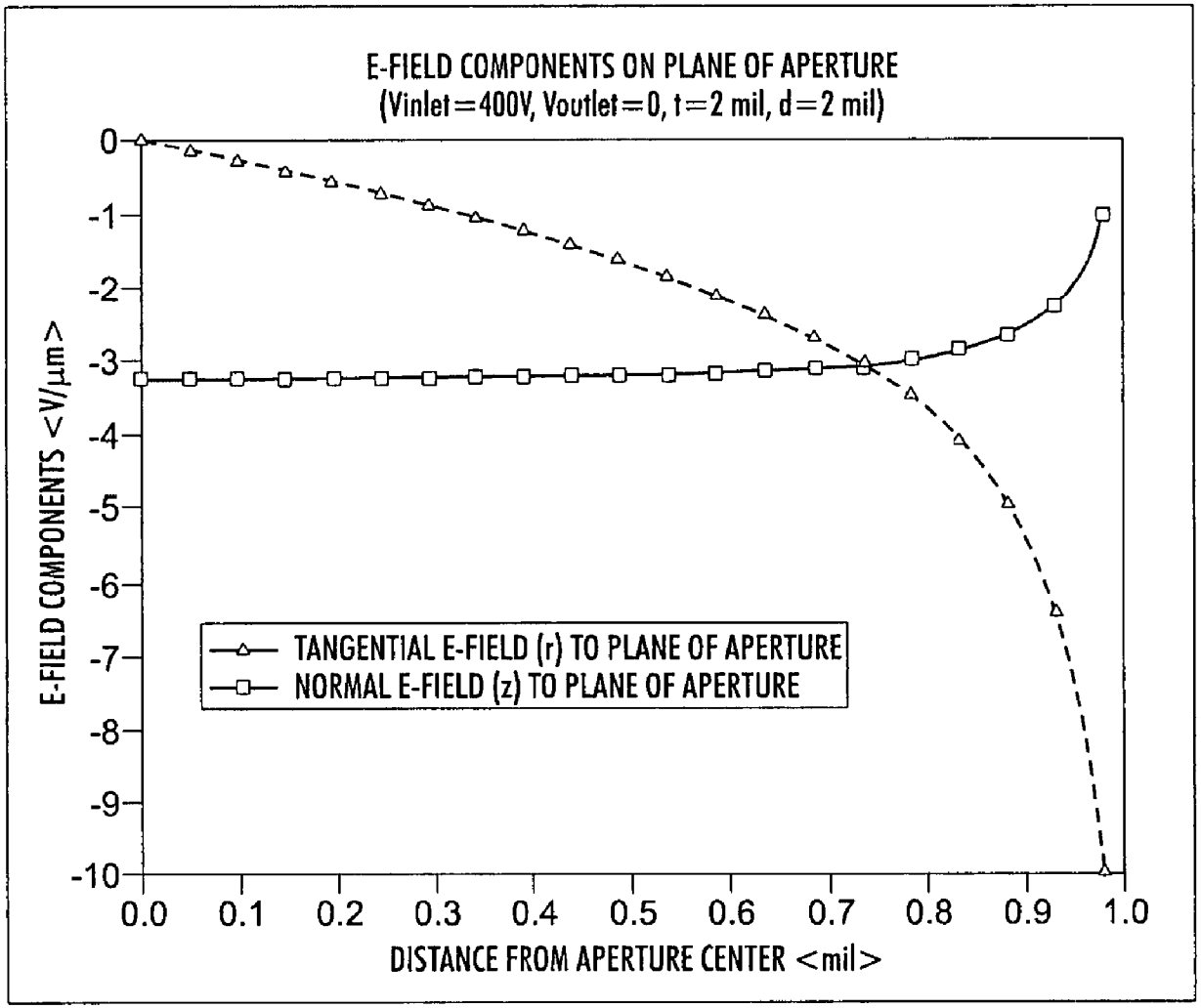
FIG. 5 is a graph of electric field components as a function of distance from the center of an aperture.

FIG. 5 illustrates the normal and tangential electric (E) field distributions on the aperture plane as a function of distance from the center of the aperture for an electrode voltage of 400 V. The curves are plotted from the center of the aperture and clearly indicate the much higher fringe fields at the aperture edge. These fields act to draw toner in from the sides to feed the aperture during gating.

Figure 6:
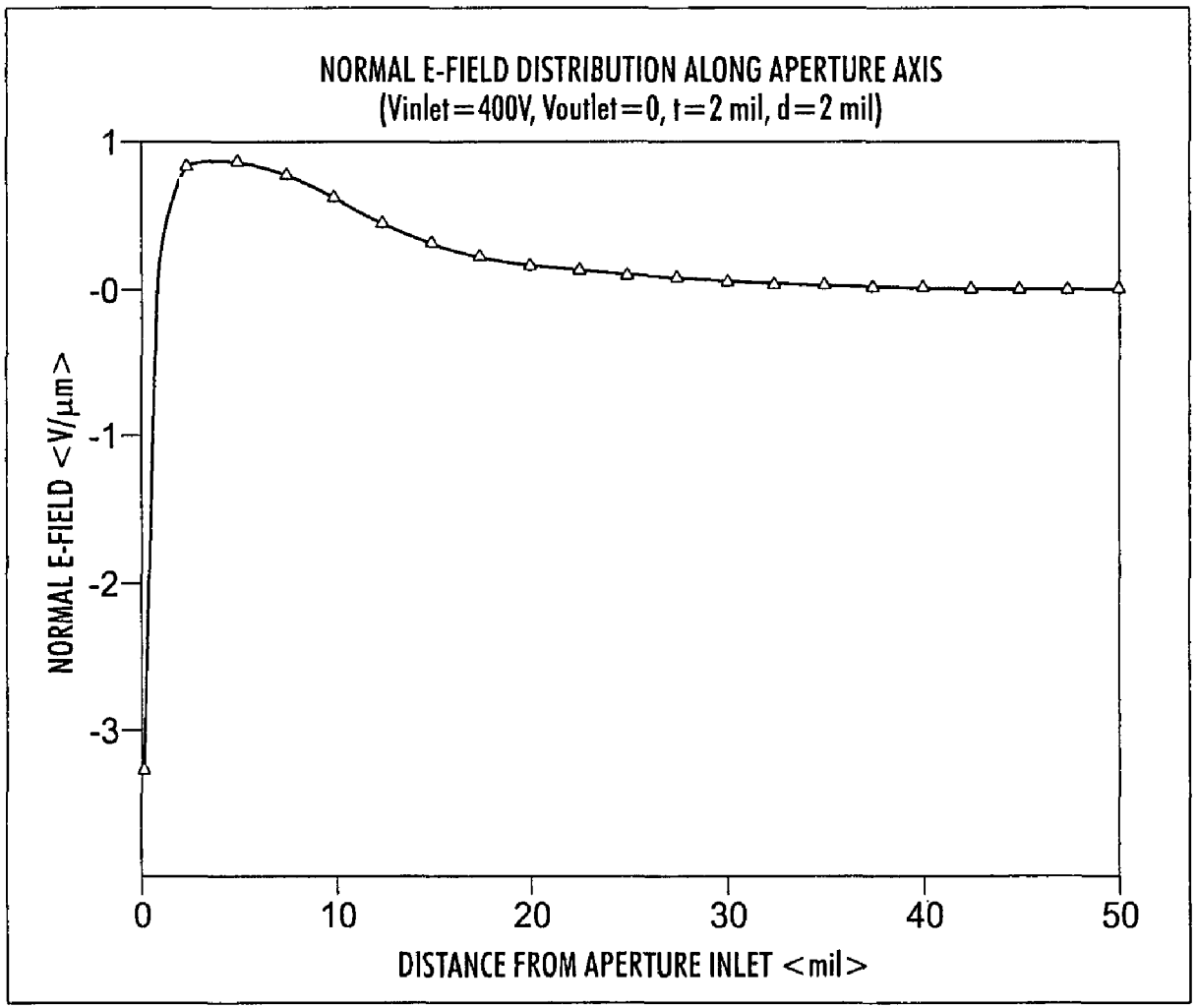
FIG. 6 is a graph of a normal electric field component as a function of distance from the inlet of an aperture.

FIG. 6 shows a plot of the axial E field as a function of distance from the plane of the aperture inlet. This field acts to pull toner in from the gap to feed the aperture. Note the field becomes negligible within 20 mils from the inlet.

The exemplary embodiment also provides additional systems and methods for continuously supplying low agglomeration toner for pixel writing in BAM. This strategy simultaneously fluidizes, transports, and supplies toner to gating apertures for on-demand printing. The system can utilize an electrostatic traveling wave implemented on a modified SED roll.

Two configurations are provided for controlled delivery of toner from a main reservoir or toner sump to a fluidization flow cell for powder BAM printing. The method of delivery uses a traveling grid with traveling waves for toner transport. One strategy involves feeding toner in a plane or "carpet" using a lateral grid which mates or otherwise interfaces with a slit along the width of a flow cell. Another strategy utilizes a grid formed as a capillary or tube to pump or otherwise transport toner into one end of the flow cell. A separate grid with a transverse orientation is then used to sweep toner back and forth in the axial direction, serving both to agitate the toner and to ensure toner uniformity.

As previously noted, research has indicated that successful gating depends on several key factors. Principal among them is that the toner can only be lightly agglomerated. A second factor is that the toner supply must be able to continually replenish the gated toner. Finally, for any required gating rate, the toner density at the aperture inlet must be controllable. The exemplary embodiment systems require consideration for fluidizing, transporting, and gating of the toner on-demand.

Figure 7:
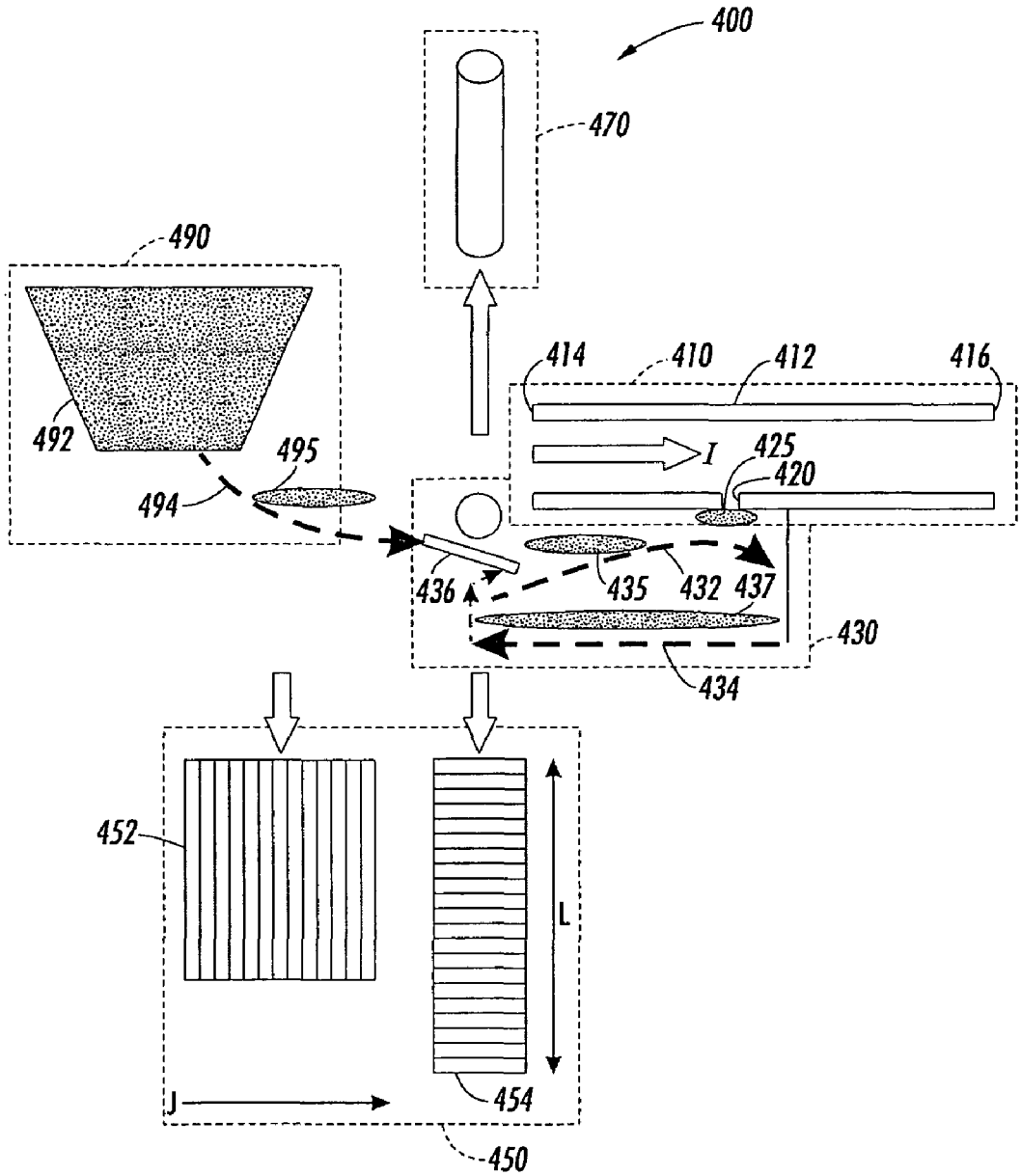
FIG. 7 is a schematic of another particle feed system in accordance with the exemplary embodiment.

Specifically, the exemplary embodiment also relates to the transport of toner from a main reservoir to a flow cell or other destination. As shown in FIG. 7, toner is moved in a controlled fashion from a main reservoir to a flow cell, at which it is gated on demand into a gas channel for delivery to a print medium. Specifically, FIG. 7 illustrates a system 400 comprising a channel 410 adapted for receiving and directing a flow of pressurized gas shown by the arrow N in FIG. 7. Specifically, gas flow I enters a channel passage 412 at an entrance 414 and flows through the channel 410 to the exit 416. Defined at a location along the channel 410 is an aperture 420. The system 400 also comprises a distribution component 430 that includes one or more traveling wave grids such as a first transport grid 432 and a second transport grid 434. The first transport grid 432 generally transports a particle or toner cloud 435 from one region of the distribution component 430 to a second region, preferably in proximity to the aperture 420. The second traveling wave grid 434 transports another particle cloud 437 typically in a reverse direction. However, the traveling wave grids 432 and 434, and addition grids, can be configured to transport particles in other desired directions or patterns. The distribution component 430 may also include a feed traveling wave grid 436 for transporting admitted particles or toner into an interior region of the component 430. This is described in greater detail herein. The system 400 also comprises a particle feed system 490 generally including a reservoir or container 492 that contains particles and/or toner. The feed component 490 also includes a transport traveling wave grid 494 for transporting or otherwise directing a particle cloud 495 from the reservoir 492 towards the distribution component 430. A variety of traveling wave grid configurations may be used to transport particles or toner such as from the feed system 490 to the distribution component 430. In one alternate embodiment, a planar traveling wave grid system 450 is used that may include a first traveling wave grid 452 and a second traveling wave grid 454. The respective grids 452 and 454 are generally arranged in different configurations with respect to each other and such that a first grid can transport particles in a direction J or opposite that direction, and the second grid 454 can transport particles in a direction transverse or perpendicular to the J direction, such as shown in FIG. 7 as direction L. The system 450 can include additional traveling wave grids. Instead of using a planar traveling wave grid system as designated by item 450 in FIG. 7, a capillary tube system such as 470 can be used. In this embodiment, a traveling wave grid, or a plurality of traveling wave grids are arranged around either the interior of the tube or the exposed outer region of the tube. Either of these systems, i.e. system 450 and/or system 470, can be used for transporting particles or toner to the distribution component 430, or within the distribution component 430.

The exemplary embodiment includes a variety of configurations of traveling wave grids. For example, if a total of 4 traveling wave grids are used, they can be arranged as follows. Referring further to FIG. 7, four traveling wave grids can be used, such as grids 494, 436, 432, and 434. Two options differ only in the use of grid 494. Grids 436, 432, and 434 are common to both configurations. Grid 436 is the collection grid for the toner from the reservoir. The grid 436 can be angled so that toner can cascade onto grid 432. The electrodes of grid 432 are aligned with the process direction, and a 4 phase traveling wave is swept back and forth which agitates the toner and distributes it somewhat uniformly. For example, an 11 inch wide grid at 0.5 cm/s toner velocity, the wave direction is switched once every 56 seconds. Grid 432 can be mounted or otherwise incorporated onto a thin molding and serve to move the toner up to the aperture such as aperture 420 for gating. The distance from the grid to the aperture entrance should be preset to about 1 mil for optimal gating throughput. The unused toner falls down to grid 434 where it is transported back toward the loading zone for recirculation. It will be appreciated that the noted description is exemplary in nature and that the embodiment includes a wide array of other configurations.

Figure 8:
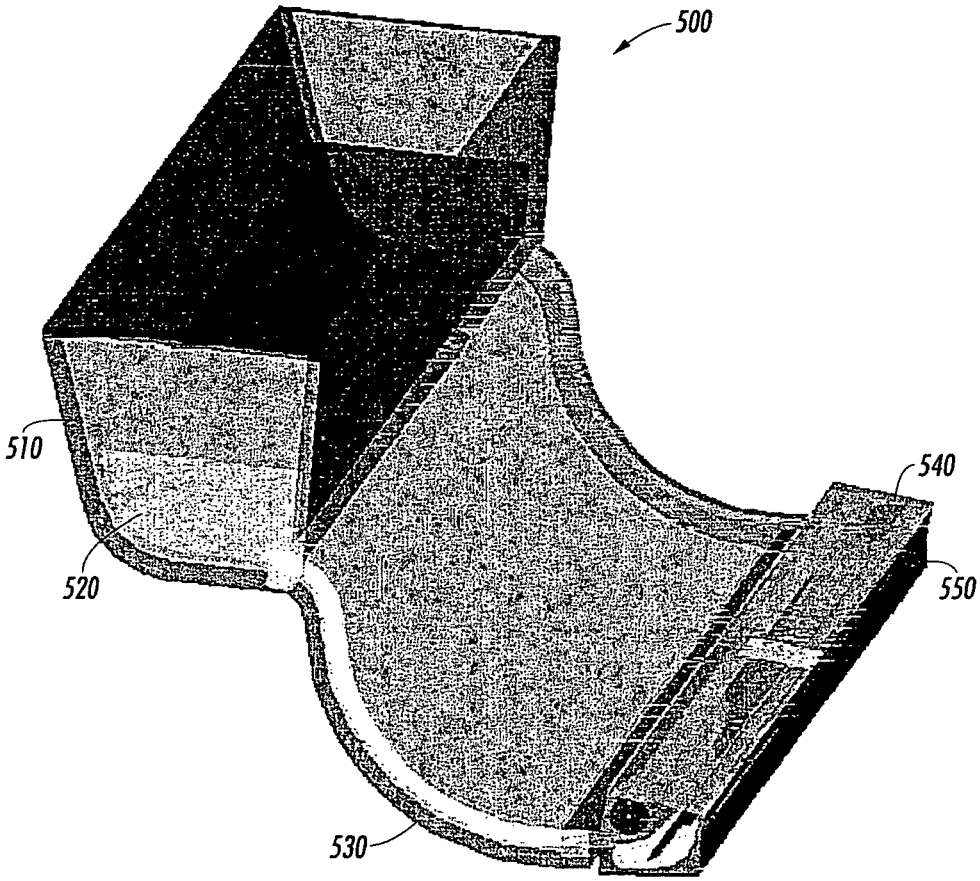
FIG. 8 is a perspective schematic view of a particle reservoir and associated traveling wave grid in accordance with the exemplary embodiment.

In another variation of the exemplary embodiment, a relatively lengthy side of the toner reservoir is mated to the long side of a flow cell with a segment of planar traveling wave grid such as grid 494 in FIG. 7 oriented so that those electrodes are also aligned with the long dimension. FIG. 8 shows a perspective view of such an exemplary embodiment assembly. Specifically, FIG. 8 schematically illustrates a reservoir system 500 comprising a container 510, an administration feed component 540 such as a flow cell defining a slit 550 along its lengthwise dimension, and one or more traveling wave grids 530 extending between the container 510 and the component 540. The container 510 is adapted to contain an amount of particles or toner 520. In certain applications, the slit-like coupling requires the traveling wave grid to be enclosed within a thin 0.5 cm toner manifold for containment. Toner is moved on demand from the container or reservoir 510 to the flow cell 540 by using feedback from optical sensors (not shown) located near the flow cell.

Figure 9:
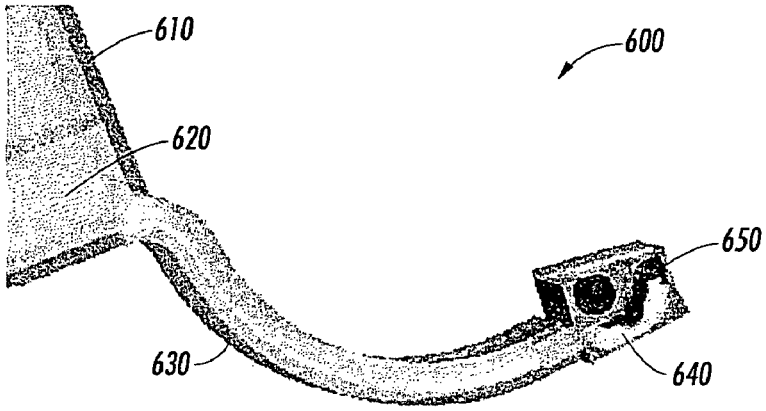
FIG. 9 is a side schematic view of a particle reservoir and associated traveling wave grid in accordance with the exemplary embodiment.

In yet another variation of the exemplary embodiment, a tube is used to join the main reservoir to the flow cell through which toner is pumped in a peristaltic manner using traveling waves. Specifically, FIG. 9 depicts an exemplary embodiment reservoir system 600 comprising a container 610 for holding particles or toner 620, a feed component 640 defining a slit or aperture 650, and one or more annular traveling wave grids 630 extending between the container 610 and the feed component 640. In this configuration, ring electrodes are deposited onto the walls of a 0.5 cm diameter tube to carry the voltage pulse trains and form grid 630. Alternatively, planar traveling wave grids can also be rolled into a tube so that the grids are transverse or substantially so, to the tube axis. When used in the system 400 shown in FIG. 7, the toner deposits onto one end of grid 436 and is then moved across the grid in the transverse direction with a bi-directional sweeping motion.

Trials with several planar and non-planar traveling wave grid arrangements have demonstrated that toner re-circulating transport is feasible. In addition, the electrostatic fields for transport of toner have been modeled and quantified. Electrodynamics of toner gating have also been modeled and optimized to successfully guide experiments. The bi-directional sweeping motion has been tested with a 90 degree coupling to a gating aperture.

Figure 10:
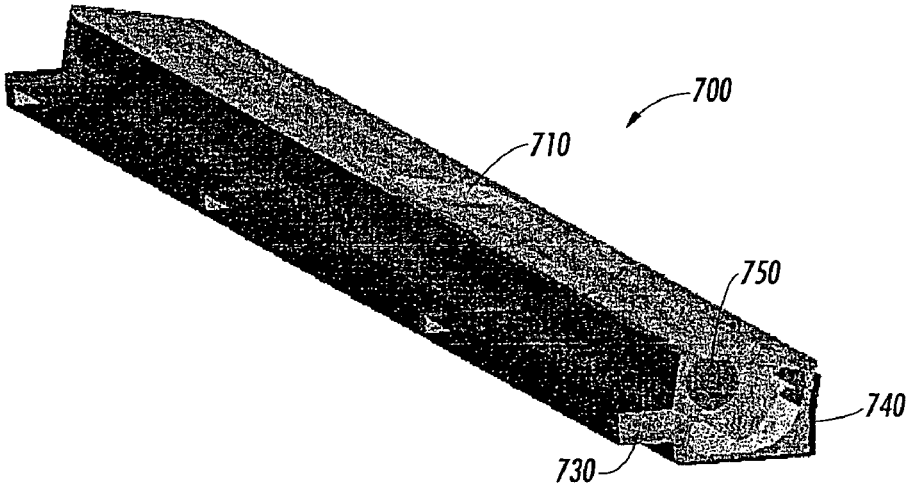
FIG. 10 is a perspective schematic view of a flow cell in accordance with the exemplary embodiment.

The use of grids 432 and 434 for toner re-circulation within a distribution component such as 430 in FIG. 7, or a flow cell, is shown in FIG. 10. Specifically, FIG. 10 illustrates a flow cell 700 that can be used as the feed component 540 or 640 shown in FIGS. 8 and 9, respectively. The cell 700 includes a plurality of apertures 710 which are arranged so that the cell 700 can couple or interface with one or more gas channels for facilitating toner delivery to a print medium. The cell also includes a toner distribution component 740 for directing toner from one or more traveling wave grids 730 to the apertures 710. One or more lateral apertures may be defined for escape of excess gas.

Generally, the exemplary embodiment traveling wave grid assemblies include a traveling wave grid or segment that is non-planar. Examples of such geometry include but are not limited to arcuate, curved, or linearly alternating or stepped configurations. The non-planar grid is positioned within a reservoir such that upon operation of the grid, the grid serves to recirculate and provide a continuous supply of particulates or material to a desired location. A significant advantage of this configuration is that it can reduce, and in certain applications, entirely eliminate, mechanical moving parts, such as may otherwise be required.

The exemplary embodiment has been described with reference to the preferred embodiments. Obviously, modifications and alternations will occur to others upon reading and understanding the preceding detailed description. It is intended that the exemplary embodiment be construed as including all such modifications and alternations insofar as they come within the scope of the appended claims or the equivalents thereof.

The invention claimed is:

1. A system for transporting particles from a first location to a feed aperture in communication with a flowing feed stream, the system comprising:

a member adapted to direct a feed stream flowing along a region of the member, the member defining an aperture extending through at least a portion of the member and providing communication with the feed stream; and at least one traveling wave grid extending from the first location to a location proximate to the aperture, wherein upon operation of the traveling wave grid and depositing particles on the traveling wave grid, at least a portion of the particles are transported from the first location, and the at least one traveling wave grid including a stationary non-planar traveling wave grid segment in the form of an annular grid defined within an interior region of a tube that remains stationary upon operation and serves to recirculate particles and provide a continuous supply of particles to the location proximate to the aperture.

2. The system of claim 1 wherein the at least one traveling wave rid further includes another traveling wave grid configured as a non-planar traveling wave grid disposed about an arcuate region of a cylinder.

3. The system of claim 1 wherein the at least one traveling wave grid further includes another traveling wave grid configured as a non-planar grid in the form of a flexible mat.

4. The system of claim 1, wherein the member defines a ballistic aerosol marking (BAM) system, including an aerosol jet with a feed stream adapted to direct high pressure gas within the region of the member.

5. The system of claim 4, wherein the aperture of the BAM system comprises at least one gating aperture of a C, M, Y and K feed system.

6. The system of claim 1, wherein the at least one traveling wave grid comprises a first traveling wave grid adjacent to a second traveling wave grid such that the first traveling wave grid can transport particles in a first direction and the second traveling wave grid can transport particles in a second direction, the second direction being generally perpendicular to the first direction.

7. The system of claim 1 wherein, the first location is at least one of a toner sump, reservoir, or storage container.

8. The system of claim 1 wherein, upon operation of the at least one traveling wave grid, particles are continuously transported in at least one of a hopping mode and a surfing mode along the traveling wave grid.

9. The system of claim 1 wherein, the tube is a capillary tube system for transporting particles to a distribution component.

10. The system of claim 1 wherein, the at least one traveling wave grid comprises a capillary tube system for transporting particles to a distribution component.

11. A system for transporting particles from a reservoir to a destination location, the system comprising:

a reservoir defining a hollow interior and a discharge, the reservoir adapted to retain and dispense particles from the discharge; and at least one traveling wave grid generally extending between a location adjoining the discharge of the reservoir and the destination location, the destination location is at least one input of a ballistic aerosol marking (BAM) system wherein upon operation of the traveling wave grid and discharge of particles from the reservoir onto the traveling wave grid, at least a portion of the particles are transported from the discharge to an aperture in communication with a feed stream at the destination location, the at least one traveling wave grid including a stationary non-planar traveling wave grid in the form of a flexible mat.

12. The system of claim 11 wherein the at least one traveling wave grid further includes another traveling wave grid configured as a planar traveling wave grid.

13. The system of claim 11 wherein the at least one traveling wave grid further includes another traveling wave grid configured as a non-planar traveling wave grid disposed about an arcuate region of a cylinder.

14. The system of claim 11 wherein the at least one traveling wave grid further includes another traveling wave grid configured as a non-planar grid in the form of an annular grid defined within an interior region of a tube.

15. The system of claim 11, wherein the at least one traveling wave grid comprises a first traveling wave grid adjacent to a second traveling wave grid such that the first traveling wave grid can transport particles in a first direction and the second traveling wave grid can transport particles in a second direction, the second direction being generally perpendicular to the first direction.

16. A system for transporting particles from a reservoir to an aperture in communication with a flowing feed stream, the system comprising:

a member adapted to direct particles to a feed stream flowing along a region of the member, the member defines a ballistic aerosol marking (BAM) system, including an aerosol jet with the feed stream adapted to direct high pressure gas within the region of the member, at least one gating aperture extending through the member and providing communication with the feed stream;

a reservoir defining a hollow interior and a discharge, the reservoir adapted to retain and dispense particles from the discharge; and at a plurality of traveling wave grids extending between a first location adjoining the at least one gating aperture, and a second location adjoining the discharge of the reservoir, a first traveling wave grid adjacent to a second traveling wave grid such that the first traveling wave grid can transport particles in a first direction and the second traveling wave grid can transport particles in a second direction, the second direction being perpendicular to the first direction wherein upon operation of the wave grids, and discharge of particles on the wave grid, at least a portion of the particles are transported from the first location to the second location.

17. The system of claim 16 wherein the at least one of the plurality of traveling wave grids include a planar traveling wave grid.

18. The system of claim 16 wherein the at least one of the plurality of traveling wave grids include a non-planar traveling wave grid configured to remain in a stationary position upon operation.

19. The system of claim 18 wherein the non-planar traveling wave grid is disposed about an arcuate region of a cylinder.

20. The system of claim 18 wherein the non-planar grid is in the form of an annular grid defined within an interior region of a tube.

21. The system of claim 18 wherein the non-planar grid is in the form of a flexible mat.

22. The system of claim 16, wherein the at least one gating aperture of the ballistic aerosol marking (BAM) system comprises a C, M, Y and K feed system.

23. The system of claim 16 wherein, there are four traveling wave grids configured to transport particles to the first location.

24. The system of claim 16 wherein, the at least one traveling wave grid is adjoined at a 90 degree coupling to the at least one gating aperture.

25. The system of claim 16 wherein, the at least one gating aperture comprises a circular shape with an inner diameter spanning about 50 μm.

* * * * *